US011761615B2

(12) United States Patent
Chen et al.

(10) Patent No.: US 11,761,615 B2
(45) **Date of Patent: *Sep. 19, 2023**

(54) LIGHTING APPARATUS

(71) Applicant: LEEDARSON LIGHTING CO., LTD., Fujian (CN)

(72) Inventors: Yizhen Chen, Fujian (CN); Zhenyu Tang, Fujian (CN); Shuxing Gao, Fujian (CN); Xu Wu, Fujian (CN)

(73) Assignee: LEEDARSON LIGHTING CO., LTD., Fujian (CN)

( * ) Notice: Subject to any disclaimer, the term of this patent is extended or adjusted under 35 U.S.C. 154(b) by 0 days.

This patent is subject to a terminal disclaimer.

(21) Appl. No.: 18/092,702

(22) Filed: Jan. 3, 2023

(65) Prior Publication Data

US 2023/0143621 A1 May 11, 2023

Related U.S. Application Data

(63) Continuation of application No. 17/588,574, filed on Jan. 31, 2022, now Pat. No. 11,566,779.

(30) Foreign Application Priority Data

Jan. 29, 2021 (CN) ..... 202120270612.8
Jan. 29, 2021 (CN) ..... 202120270727.7
(Continued)

(51) Int. Cl.
*F21V 21/14* (2006.01)
*F21V 23/00* (2015.01)
(Continued)

(52) U.S. Cl.
CPC ..... *F21V 21/14* (2013.01); *F21V 7/04* (2013.01); *F21V 23/002* (2013.01); *F21V 23/007* (2013.01); *F21Y 2115/10* (2016.08)

(58) Field of Classification Search
CPC ..... F21V 7/04; F21V 21/14; F21V 23/002; F21V 23/007
See application file for complete search history.

(56) References Cited

U.S. PATENT DOCUMENTS 2,649,535 A * 8/1953 Abrahamh ..... F21S 8/04 362/275
7,748,868 B2 * 7/2010 Patti ..... F21S 8/02 362/147

(Continued)

*Primary Examiner* — Christopher E Dunay
(74) *Attorney, Agent, or Firm* — Chun-Ming Shih; LANWAY IPR SERVICES

(57) ABSTRACT

A lighting apparatus includes a dome housing, a first rotation shaft, a light body, a second rotation shaft and a rotation bracket. The dome housing includes a rim part and a container part. The container part defines a semi-sphere space. The rim part conceals an installation cavity for installing the lighting apparatus. The light body includes a light source. The light body is attached to the container part with the first rotation shaft. The light body is rotatable with respect to the container part along the first rotation shaft for a first rotation direction. The rotation shaft is disposed to the container part with a tilt offset from a top center of the container part. The rotation bracket has a fixing bracket and a central part.

20 Claims, 19 Drawing Sheets

(30) Foreign Application Priority Data

Jan. 29, 2021 (CN) ..... 202120270952.0
Jan. 29, 2021 (CN) ..... 202120273561.4

(51) Int. Cl.
*F21V 7/04* (2006.01)
*F21Y 115/10* (2016.01)

(56) References Cited

U.S. PATENT DOCUMENTS

| | | | | |
|---|---|---|---|---|
| 8,215,805 | B2 * | 7/2012 | Cogliano | F21V 21/04 362/365 |
| 8,226,278 | B2 * | 7/2012 | Ward | F21V 21/30 362/427 |
| 11,105,496 | B1 * | 8/2021 | Huang | F21V 17/105 |
| 11,215,345 | B2 * | 1/2022 | Maghnagi | F21V 21/15 |
| 11,428,388 | B1 * | 8/2022 | Hargroder | F21V 21/14 |
| 2016/0169490 | A1 * | 6/2016 | Kijima | F21V 21/15 362/372 |
| 2017/0307193 | A1 * | 10/2017 | Fujisawa | F21V 27/00 |
| 2018/0187872 | A1 * | 7/2018 | Chou | F21V 23/002 |
| 2020/0116340 | A1 * | 4/2020 | Nikooyan | F21V 21/04 |

* cited by examiner

LIGHTING APPARATUS

RELATED APPLICATION

The present application is a continued application of U.S. patent application Ser. No. 17/588,574.

FIELD

The present invention is related to a lighting apparatus, and more particularly related to a lighting apparatus with a movable structure.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

Downlight devices are widely used in various places. Usually downlight devices are installed in cavities of a ceiling. Such cavity may be a reserved cavity of a ceiling or a junction box pre-installed to a ceiling.

It is beneficial to adjust a light direction of the downlight device. This is helpful when the downlight is used for emitting a light beam. This is also helpful even the downlight device does not emit a light beam. In such case, the light direction adjustment may help to emphasize a desired area and therefore to emit light more effectively.

SUMMARY

In some embodiments, a lighting apparatus includes a dome housing, a first rotation shaft, a light body, a second rotation shaft and a rotation bracket.

The dome housing includes a rim part and a container part.

The container part defines a semi-sphere space.

The rim part conceals an installation cavity for installing the lighting apparatus.

The light body includes a light source.

The light body is attached to the container part with the first rotation shaft. The light body is rotatable with respect to the container part along the first rotation shaft for a first rotation direction.

The rotation shaft is disposed to the container part with a tilt offset from a top center of the container part.

The rotation bracket has a fixing bracket and a central part.

The dome housing is attached to the top center of the central part with the second rotation shaft for the dome housing to be rotatable with respect to the rotation bracket for a second rotation direction.

The fixing bracket is detachably attached to the installation cavity.

In some embodiments, the first rotation direction is along a first axis and the second rotation direction is along a second axis.

The first axis and the second axis has a tilt angle.

In some embodiments, the tilt angle is between 10 degrees to 45 degrees.

In some embodiments, the container part of the dome housing has a bowl shape.

In some embodiments, the first rotation shaft has a first limiting unit for limiting a first maximum rotation angle of the first rotation direction.

In some embodiments, the second rotation shaft has a second limiting unit for limiting a second maximum rotation angle of the second rotation direction.

In some embodiments, the lighting apparatus may also include a driver box attached to the central part of the rotation bracket.

The driver box and the dome housing are placed on opposite sides of the central part.

In some embodiments, a driver circuit in the driver box is electrically connected to the light source in the light body via a first conductive path of the second rotation shaft, a second conductive path of the container part and a third conductive path of the first rotation shaft.

In some embodiments, the central part is an elongated bar with a central hole for the second rotation shaft to rotate within the central hole.

In some embodiments, the fixing bracket has two fixing units disposed on two opposite sides of the elongated bar.

In some embodiments, the central bar has two sliding tracks for moving the two fixing units to adjust a spanning diameter between the two fixing units to fit in different sizes of the installation cavity.

In some embodiments, the light source includes a LED module.

The light body includes an optical module for changing a light path of a light of the light source.

In some embodiments, the optical module includes a reflective cup for guiding the light to a light opening of the light body.

In some embodiments, an inner side of the dome housing has a reflective layer for reflecting the light of the light source.

In some embodiments, the light body has a handle for a user to hold to rotate the light body along the first rotation shaft.

In some embodiments, the user holds the handle to rotate the dome housing along the second rotation shaft.

In some embodiments, the handle has a switch for changing a light parameter of the light source.

In some embodiments, the switch has a rotation switch part for setting a maximum light intensity of the light source.

In some embodiments, the switch further has a mode switch for adjusting a color temperature of a mixed light output of the light source.

In some embodiments, the first rotation shaft has a first wiring hole.

The second rotation shaft has a second wiring hole.

The first wiring hole and the second wiring hole are used for passing a metal wire for electrically connecting a driver circuit to the light source.

DETAILED DESCRIPTION

Figure 18:
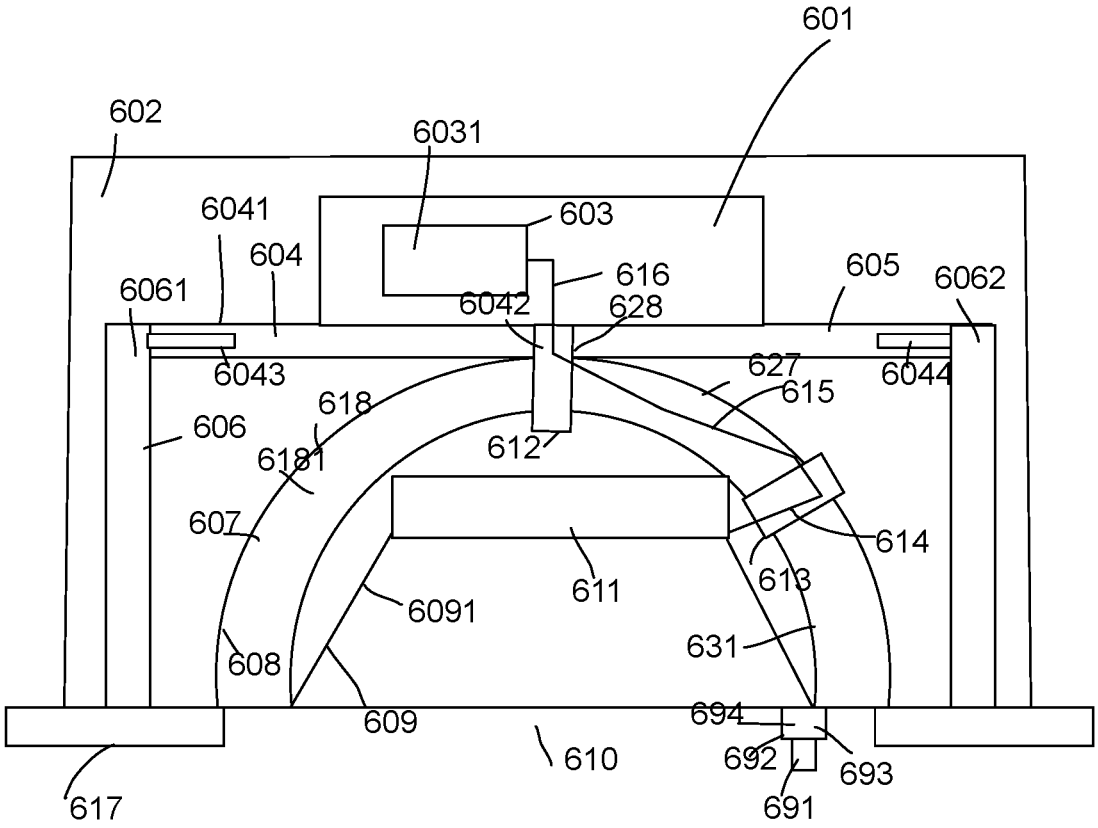
FIG. 18 illustrates a lighting apparatus embodiment.

In FIG. 18, a lighting apparatus includes a dome housing 607, a first rotation shaft 613, a light body 631, a second rotation shaft 612 and a rotation bracket 605.

The dome housing 607 includes a rim part 617 and a container part 618.

The container part 618 defines a semi-sphere space 6181.

The rim part 617 conceals an installation cavity 602 for installing the lighting apparatus.

The light body 631 includes a light source 611.

The light body 631 is attached to the container part 618 with the first rotation shaft 613. The light body 631 is rotatable with respect to the container part 618 along the first rotation shaft 613 for a first rotation direction.

Figure 19:
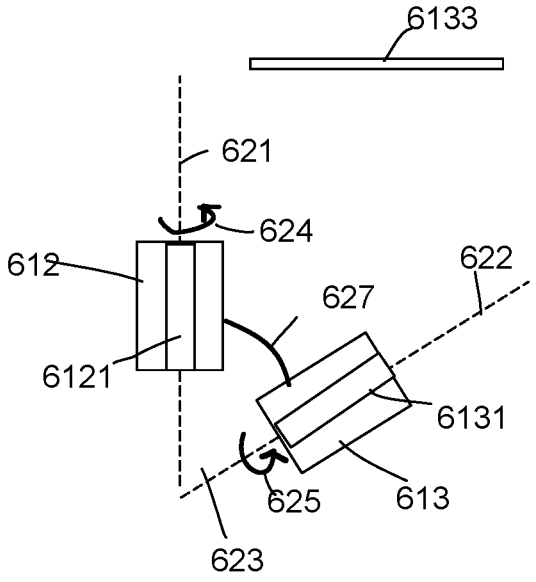
FIG. 19 illustrates the rotation directions and the tilt angle of the first rotation shaft and the second rotation shaft.

FIG. 19 shows a first rotation direction 625 is performed by rotating the light body with respect to the dome housing 607 along the first rotation shaft 613. The rotation direction 625 is rotated along a first axis 622.

In FIG. 18, the first rotation shaft 614 is disposed to the container part 618 with a tilt offset 627 from a top center 628 of the container part 618.

The rotation bracket 605 has a fixing bracket 606 and a central part 604.

The dome housing 607 is attached to the top center 628 of the central part 605 with the second rotation shaft 612 for the dome housing 607 to be rotatable with respect to the rotation bracket 604 for a second rotation direction.

FIG. 19 shows the second rotation shaft 612 and the second rotation direction 624. The second rotation direction 624 is rotated along a second axis 621.

In FIG. 18, the fixing bracket 606 is detachably attached to the installation cavity 602.

In FIG. 19, the first rotation direction 625 is along a first axis 622 and the second rotation direction 624 is along a second axis 621.

The first axis 622 and the second axis 621 has a tilt angle 623.

In some embodiments, the tilt angle is between 10 degrees to 45 degrees.

In FIG. 18, the container part 618 of the dome housing 607 has a bowl shape.

In some embodiments, the first rotation shaft 613 has a first limiting unit for limiting a first maximum rotation angle of the first rotation direction.

Some examples of the first limiting unit are provided in following embodiments. The first limiting unit may include a protruding block of one component that may be stopped by a corresponding structure on another component when said one component is rotated with respect to said another component.

In some embodiments, the second rotation shaft 612 has a second limiting unit for limiting a second maximum rotation angle of the second rotation direction.

In some embodiments, the lighting apparatus may also include a driver box 601 attached to the central part 628 of the rotation bracket 605.

The driver box 601 and the dome housing 605 are placed on opposite sides of the central part 604.

In some embodiments, a driver circuit 603 in the driver box 601 is electrically connected to the light source 611 in the light body 631 via a first conductive path 616 of the second rotation shaft 612, a second conductive path 615 of the container part 607 and a third conductive path 614 of the first rotation shaft 613.

In some embodiments, the central part 604 is an elongated bar 6041 with a central hole 6042 for the second rotation shaft 612 to rotate within the central hole 6042. Examples of the central part 604 is further explained in following embodiments.

In some embodiments, the fixing bracket has two fixing units 6061, 6062 disposed on two opposite sides of the elongated bar 6041.

In some embodiments, the elongated bar 604 has two sliding tracks 6043, 6044 for moving the two fixing units 6061, 6062 to adjust a spanning diameter between the two fixing units 6061, 6062 to fit in different sizes of the installation cavity 602.

In some embodiments, the light source 603 includes a LED module 6031.

The light body includes an optical module 609 for changing a light path of a light of the light source 611.

In some embodiments, the optical module includes a reflective cup 6091 for guiding the light to a light opening of the light body 631.

In some embodiments, an inner side of the dome housing has a reflective layer 608 for reflecting the light of the light source 611.

In some embodiments, the light body has a handle 691 for a user to hold to rotate the light body 631 along the first rotation shaft 613.

In some embodiments, the user holds the handle 691 to rotate the dome housing 607 along the second rotation shaft 612. This may be performed because the light body is attached to the dome housing 607.

In some embodiments, the handle 691 has a switch 692 for changing a light parameter of the light source.

In some embodiments, the switch 692 has a rotation switch part 693 for setting a maximum light intensity of the light source 611.

In some embodiments, the switch 692 further has a mode switch 694 for adjusting a color temperature of a mixed light output of the light source 611.

In FIG. 19, the first rotation shaft 613 has a first wiring hole 6131.

The second rotation shaft 612 has a second wiring hole 6121.

The first wiring hole 6131 and the second wiring hole 6121 are used for passing a metal wire 6133 for electrically connecting a driver circuit to the light source.

Please refer to FIG. 1 to FIG. 17, which illustrate detailed examples for above embodiment. The same reference numerals refer to the same components among the drawings and may not be described again if being mentioned for brevity.

Figure 1:
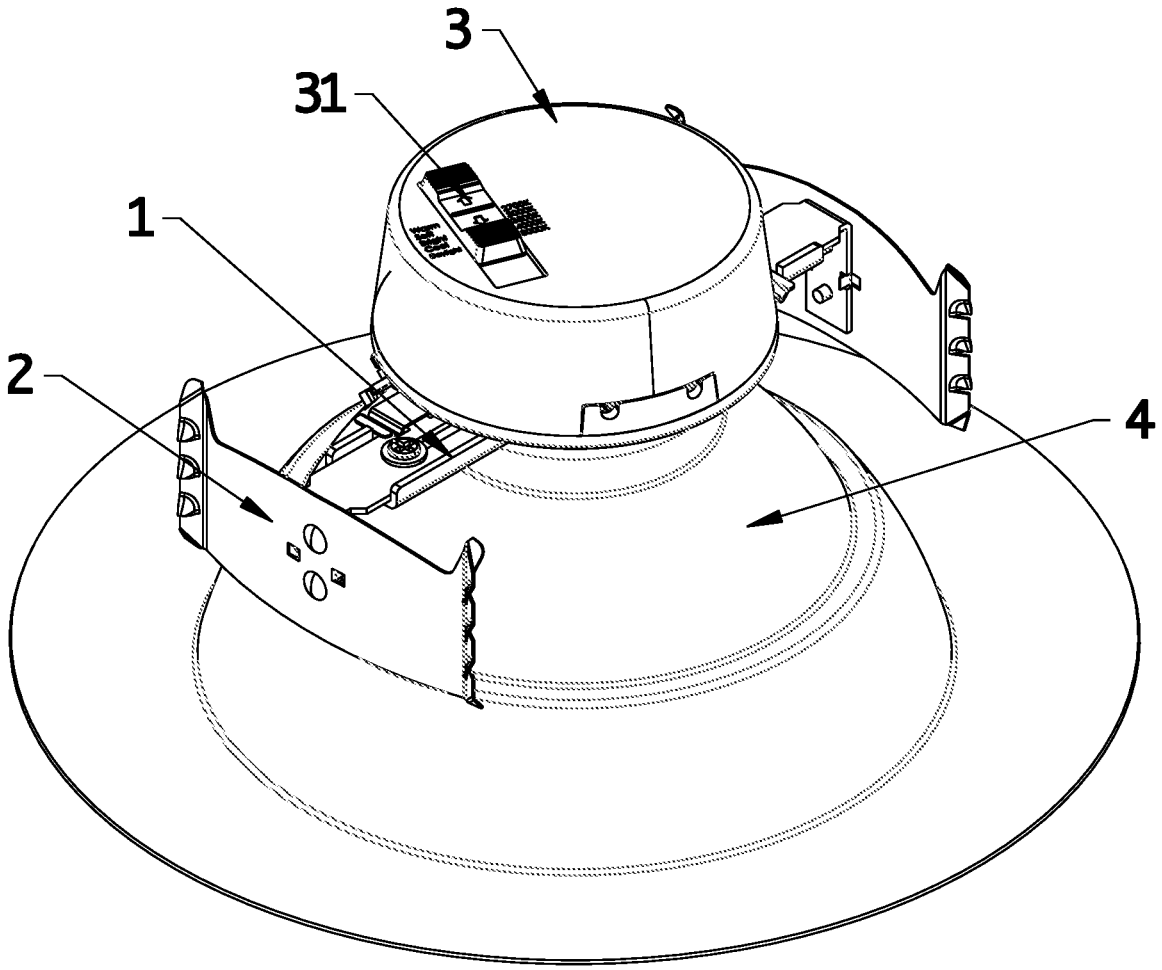
FIG. 1 illustrates a downlight embodiment of a lighting apparatus.

FIG. 1 illustrates a downlight embodiment of a lighting apparatus. In FIG. 1, the driver box 3 has a top cover 31 with a manual switch for setting a light parameter, like a color temperature of the lighting apparatus. There is a rotation bracket that has a central part 1 and a fixing bracket 2. The dome housing 4 and the driver box 3 are disposed on two opposite sides of the central part 1.

Figure 2:
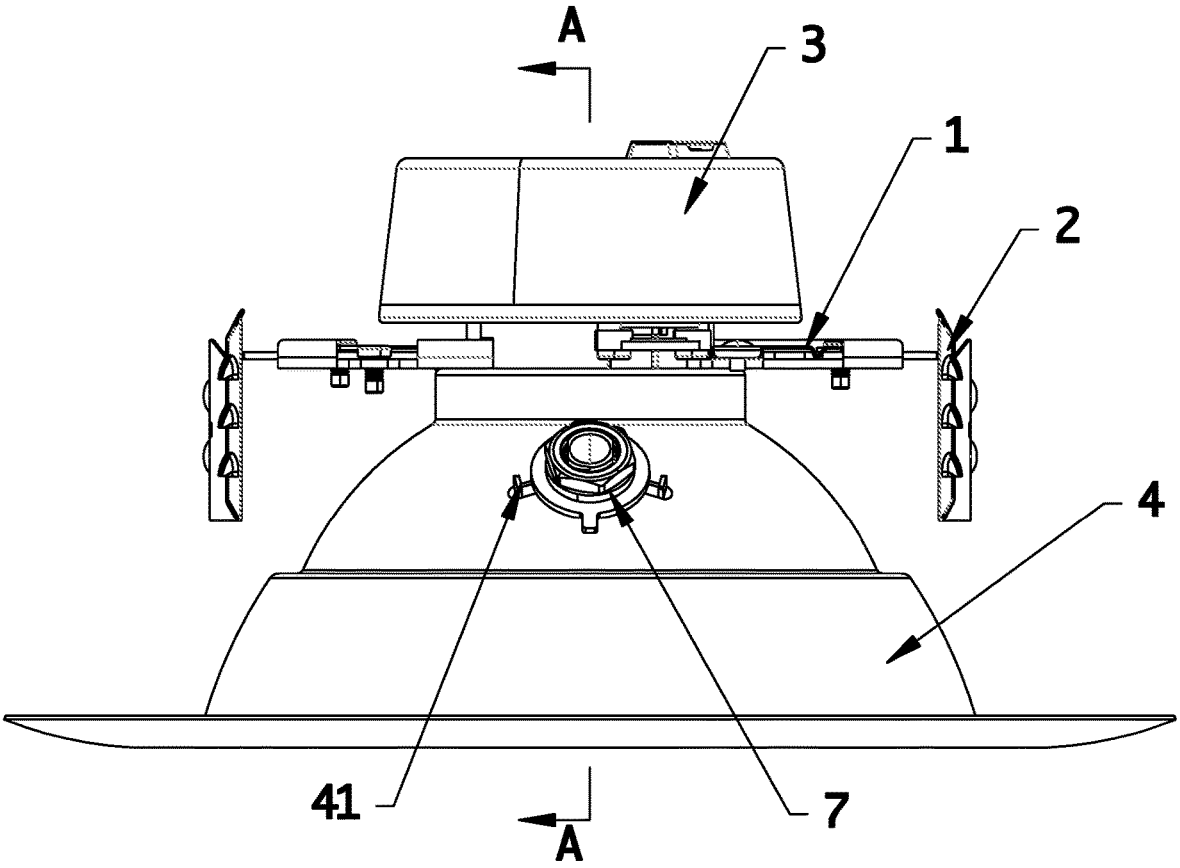
FIG. 2 illustrates a side view of the example in FIG. 1.

FIG. 2 illustrates a side view of the example in FIG. 1. In addition to the components mentioned above, the lighting apparatus has a first limiting unit 41 which is a protruding block for limiting a rotation angle of the first rotation shaft 7. The first rotation shaft 7 may include multiple components for performing a rotation between two components. Various known structures may be used. Parts of the first rotation shaft 7, as well as the second rotation shaft, may be integrated with the two components to be rotated with each other.

Figure 3:
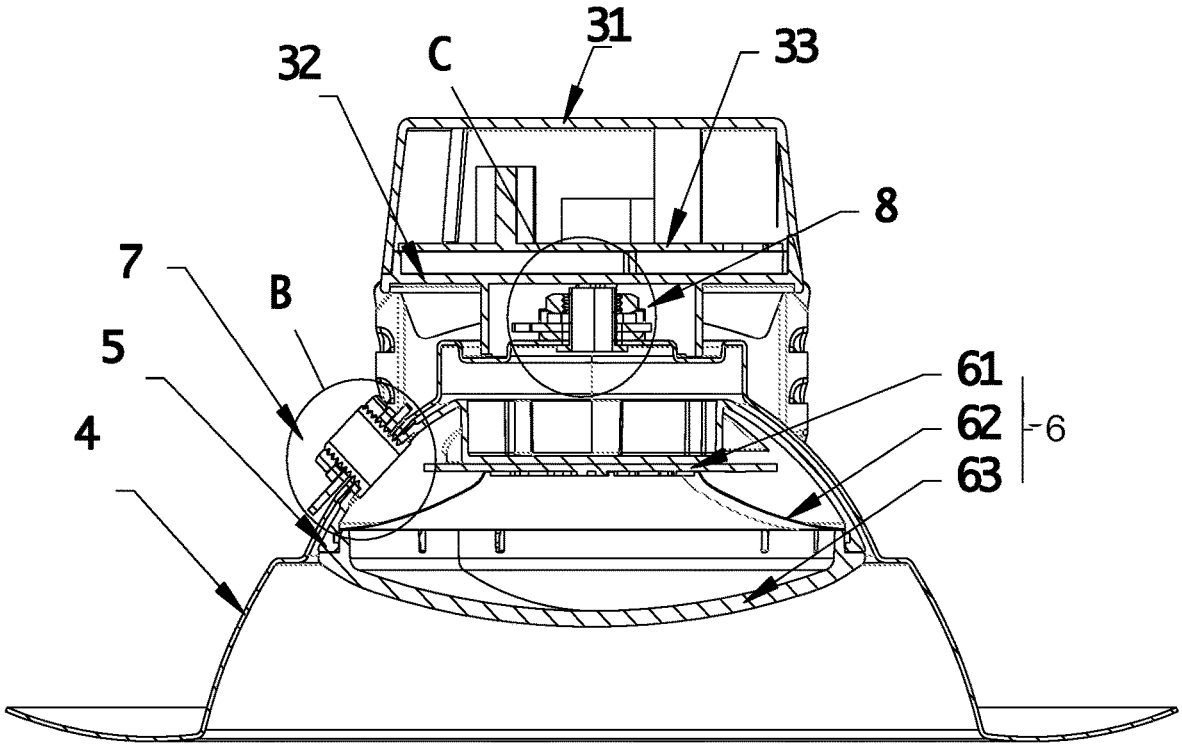
FIG. 3 illustrates a cross-sectional view of the example in FIG. 1.

FIG. 3 illustrates a cross-sectional view of the example in FIG. 1. In FIG. 3, the driver circuit 33 is placed in the driver box 3. There is a second rotation shaft 8 for the dome housing 4 to be rotated with respect to the rotation bracket. The light source 6 may include a light source plate, a reflective cup 62 and a light passing cover 63. The dome housing 4 may has a heat dissipation housing 5.

Figure 4:
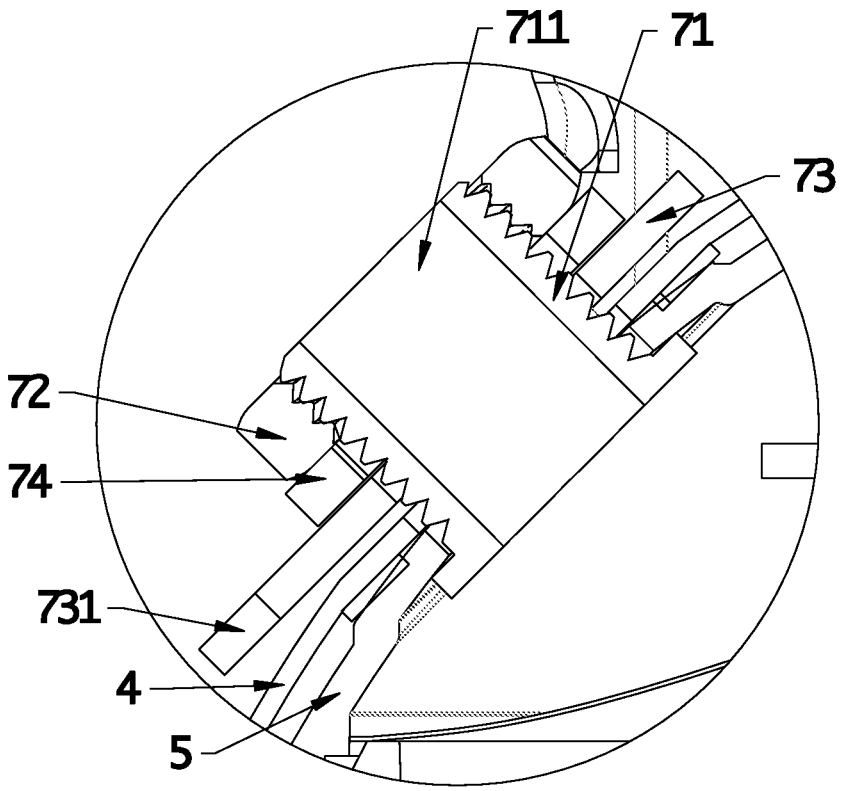
FIG. 4 illustrates a zoom-up view of a first rotation shaft.

FIG. 4 illustrates a zoom-up view of a first rotation shaft. FIG. 4 illustrates components of the first rotation shaft that may include a first rotation lever 71, a first stopping pad ring 73, a first stop part 72, a first wave shape pad 74, and a first limiting block 731 for performing a limiting rotation. A first wiring hole 711 is reserved for allowing a wire to pass through.

Figure 5:
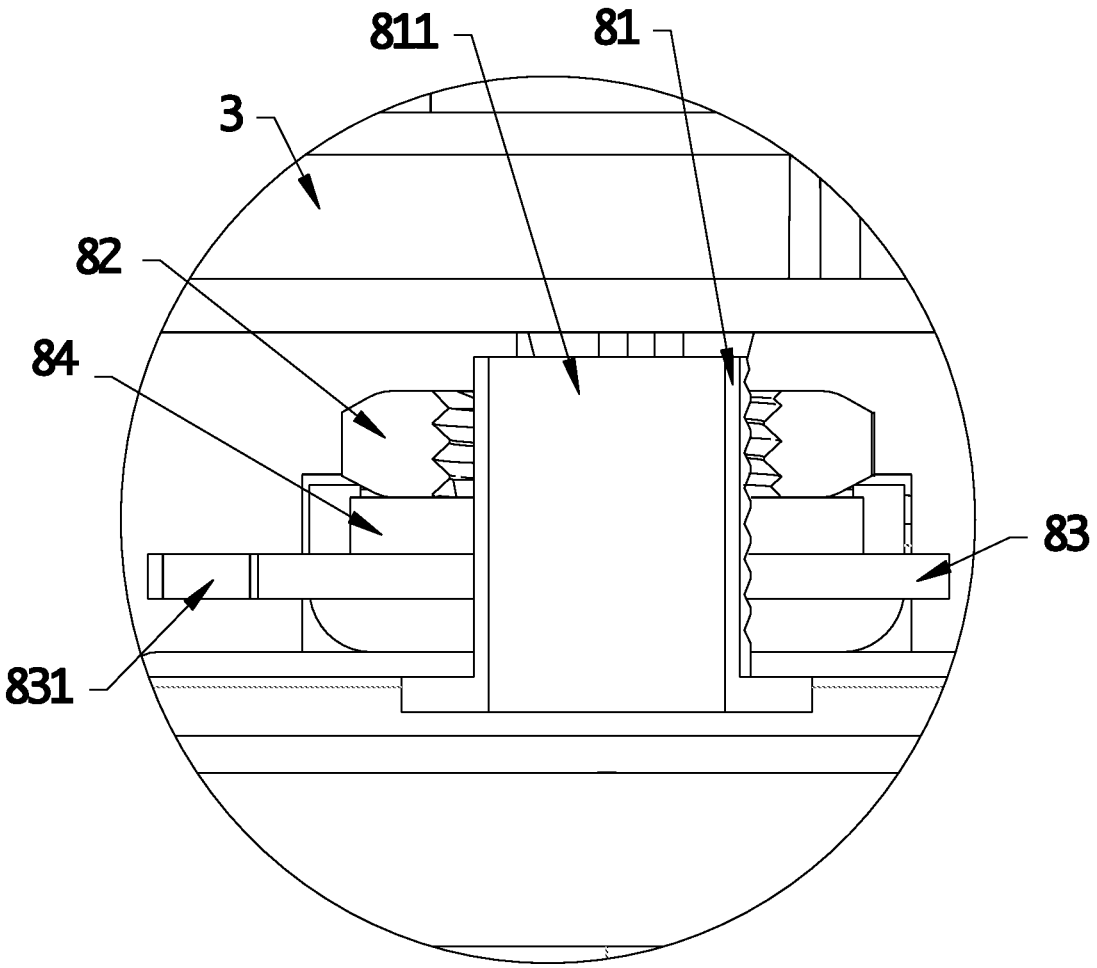
FIG. 5 illustrates a zoom-up view of a second rotation shaft.

FIG. 5 illustrates a zoom-up view of a second rotation shaft. The second rotation shaft has a second rotation lever 81 that has a second wiring hole 811. There is a second stopping unit 82 that has a second wave shape pad 84, a second stopping pad ring 83 and a second stopping block 831.

Figure 6:
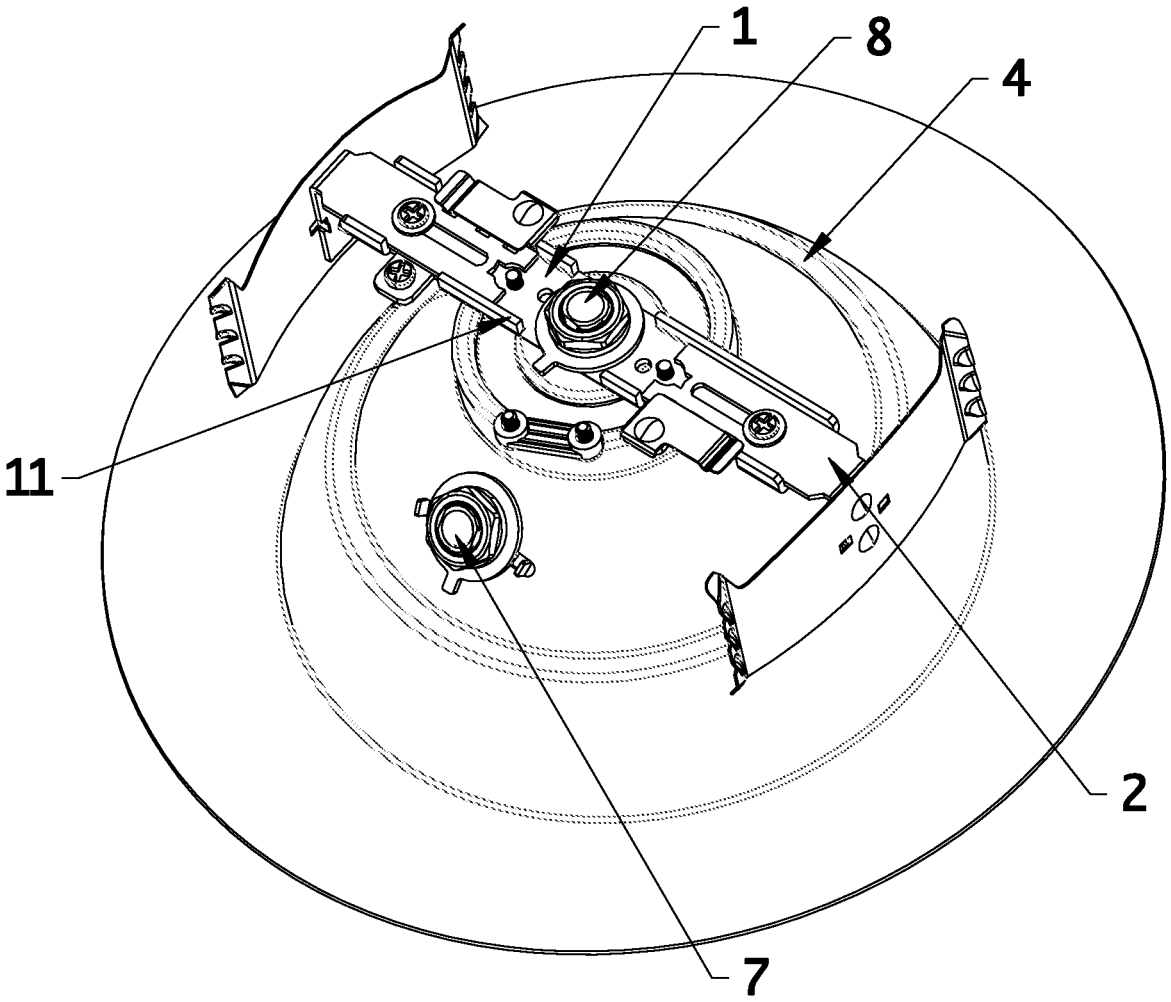
FIG. 6 illustrates a top view of the example in FIG. 1.

FIG. 6 illustrates a top view of the example in FIG. 1. The rotation of the second rotation shaft 8 is limited by the second limiting block 11. FIG. 6

Figure 7:
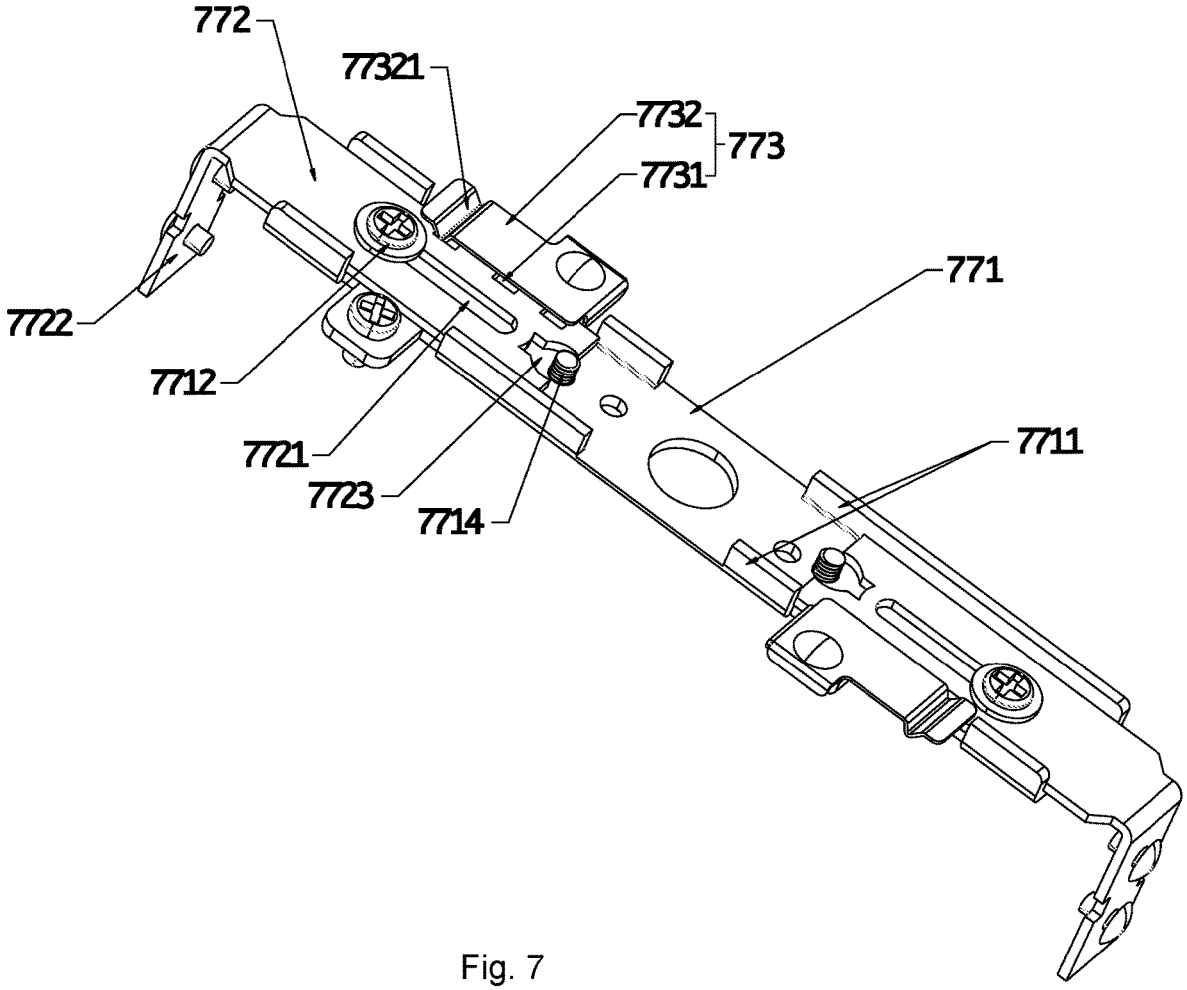
FIG. 7 illustrates an example of an elongated bar.

FIG. 7 illustrates an example of an elongated bar that has an adjustment plate 772, a limiting part 77321, a limiting unit 773 with clips 7732 placed in a limiting groove 7731, a connecting plate 771, a folded edge 7711, a connector bolt 7714, an escape 7723, a sliding track 7721, a limiting bolt 7712, and a fixing bracket 7722.

Figure 8:
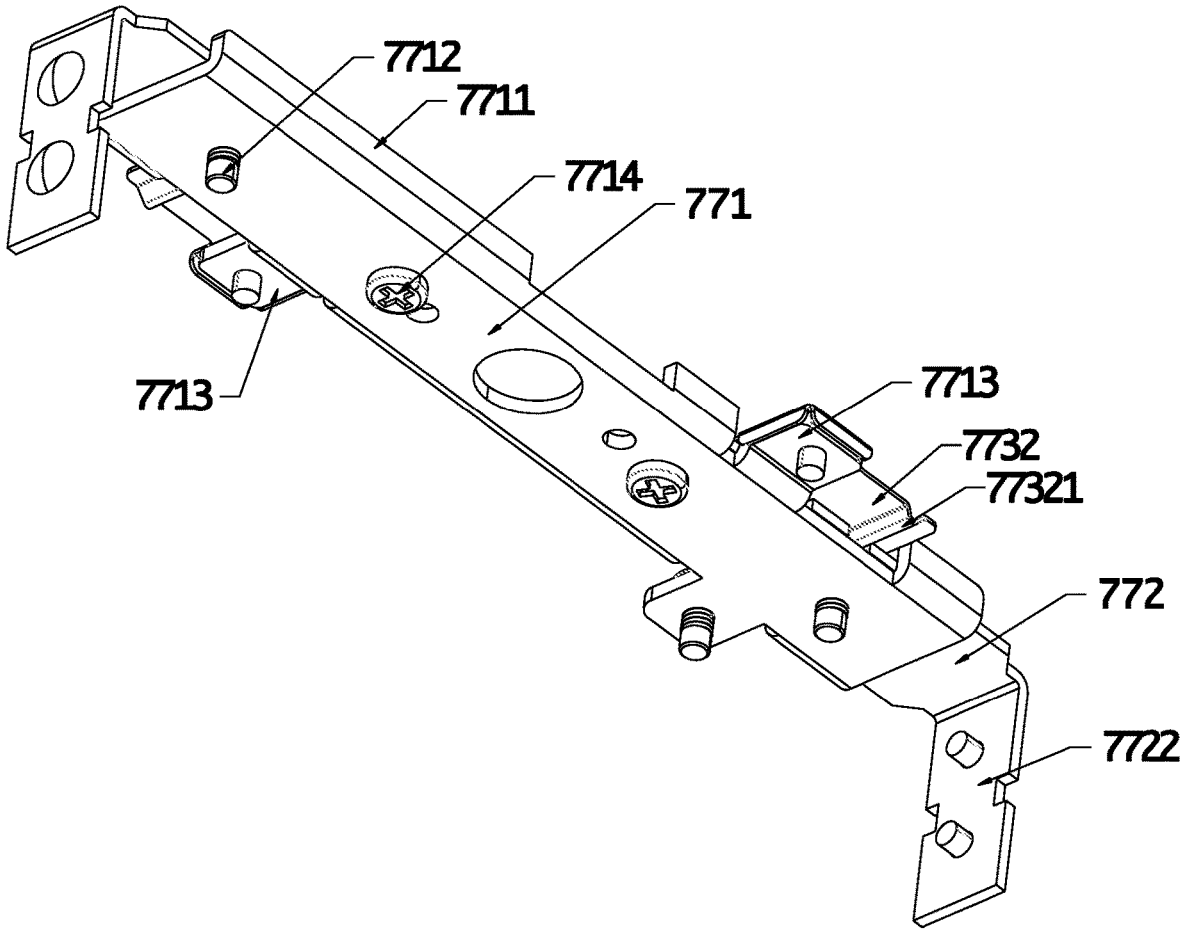
FIG. 8 illustrates another view of the example in FIG. 7.

FIG. 8 illustrates another view of the example in FIG. 7.

Figure 9:
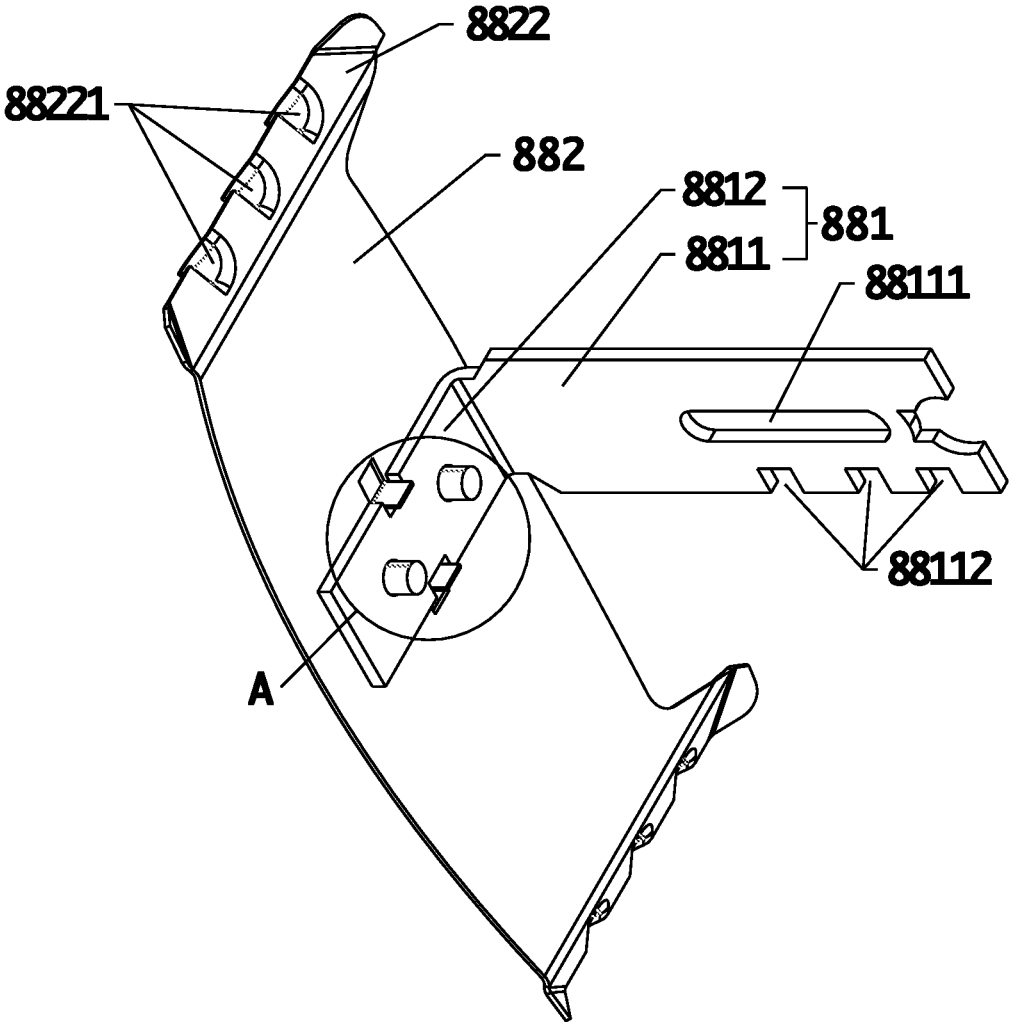
FIG. 9 illustrates an example of a fixing bracket connecting to the central part.

FIG. 9 illustrates an example of a fixing bracket connecting to the central part. The structure has a folding structure 88221, a folding edge 8822, a support plate 882, a connector plate 881 with two connecting parts 8812, 8811, a sliding groove 88111 and some positioning grooves 88112.

Figure 10:
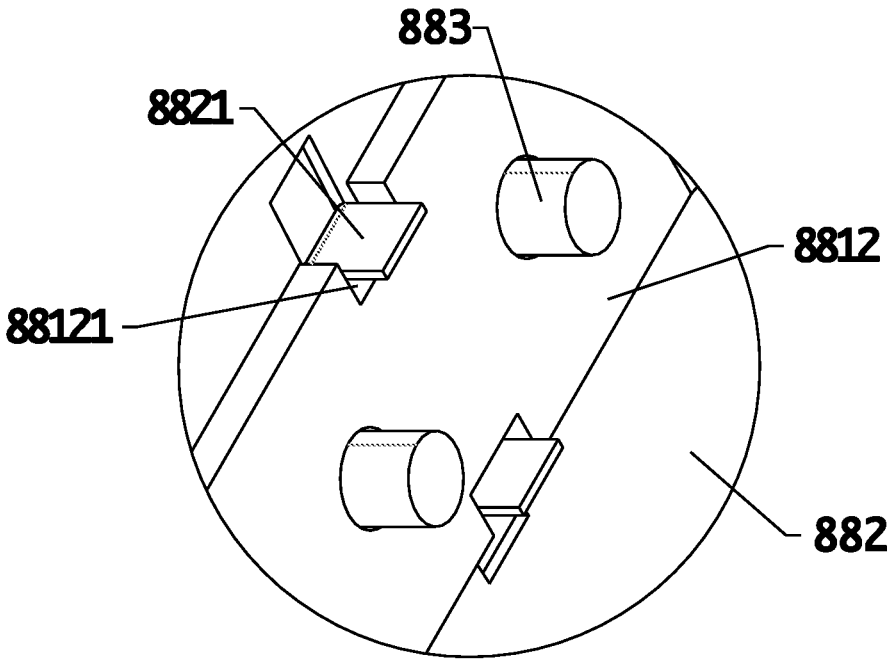
FIG. 10 illustrates a zoom-up view of an area of the rotation bracket.

FIG. 10 illustrates a zoom-up view of an area of the rotation bracket. The zoom-up view illustrates the positioning unit 883, the limiting block 8821 and the limiting escape 88121.

Figure 11:
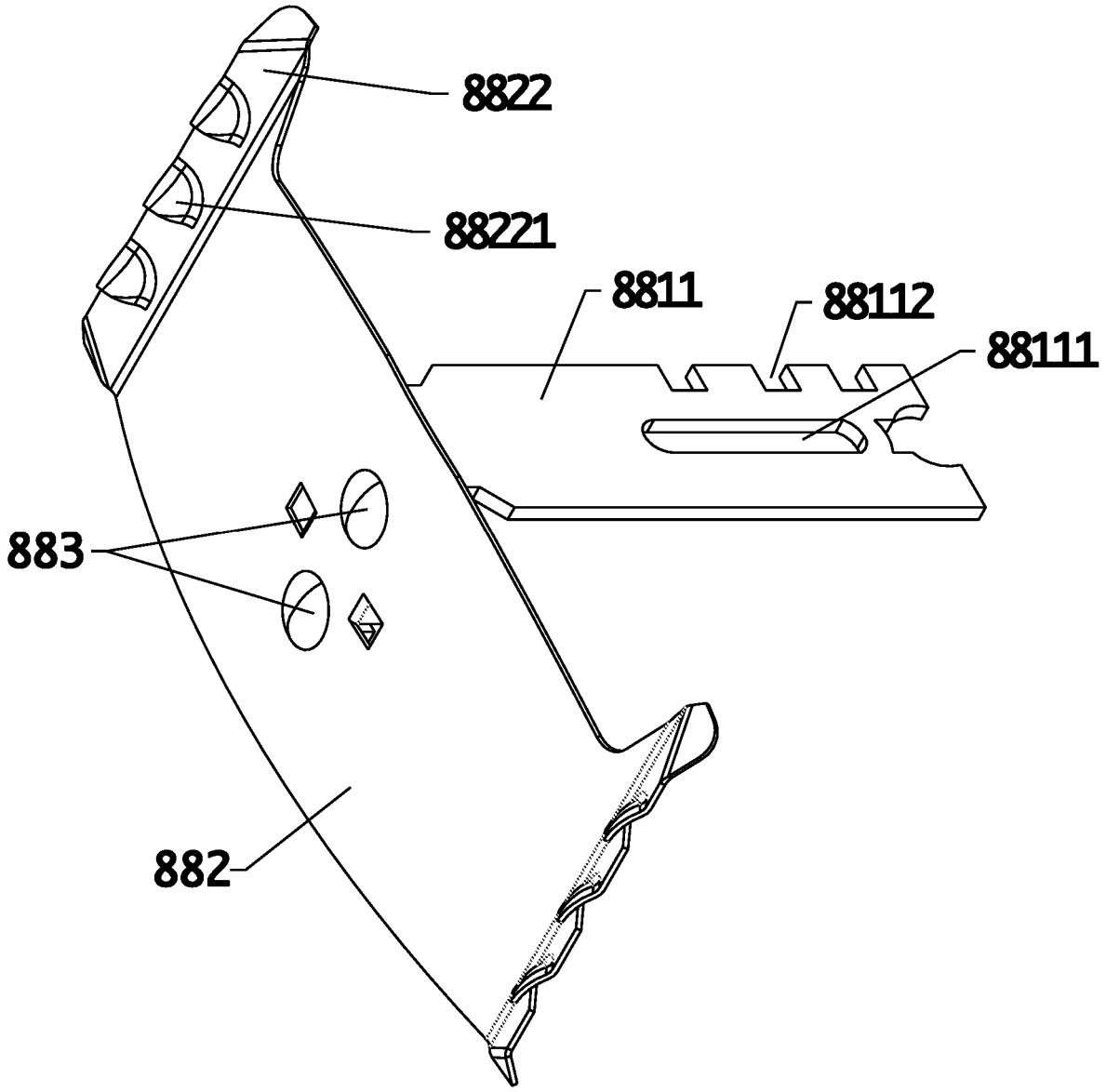
FIG. 11 illustrates another view of the example in FIG. 9.

FIG. 11 illustrates another view of the example in FIG. 10.

Figure 12:
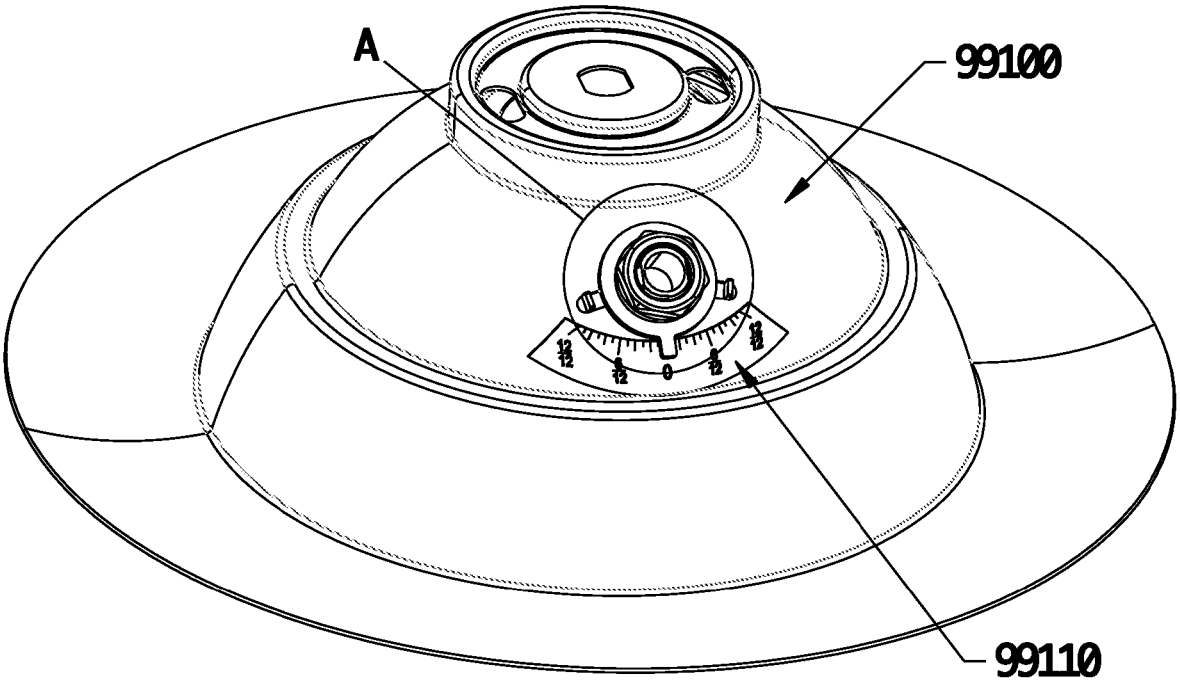
FIG. 12 illustrates an example of a dome housing and a light body.

FIG. 12 illustrates an example of a dome housing and a light body. In FIG. 12, the dome housing 99100 has some labels 99110.

Figure 13:
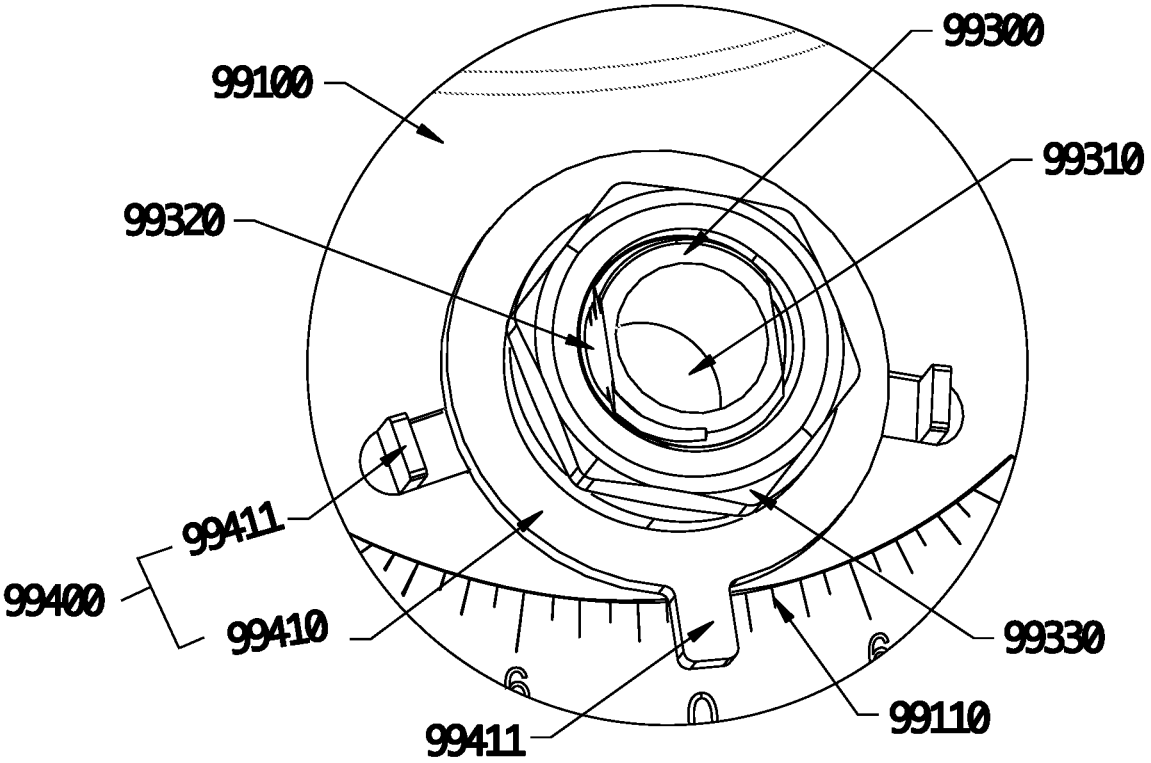
FIG. 13 illustrates a zoom-up view of the example in FIG. 12.

FIG. 13 illustrates a zoom-up view of the example in FIG. 12 that shows a rotation lever 99300, a wiring hole 99310, a positioning face 99320, a limiting unit that has a positioning block 99411 and a stopping pad 99410, a positioning block 99411, a screw 99330 to provide a rotation shaft.

Figure 14:
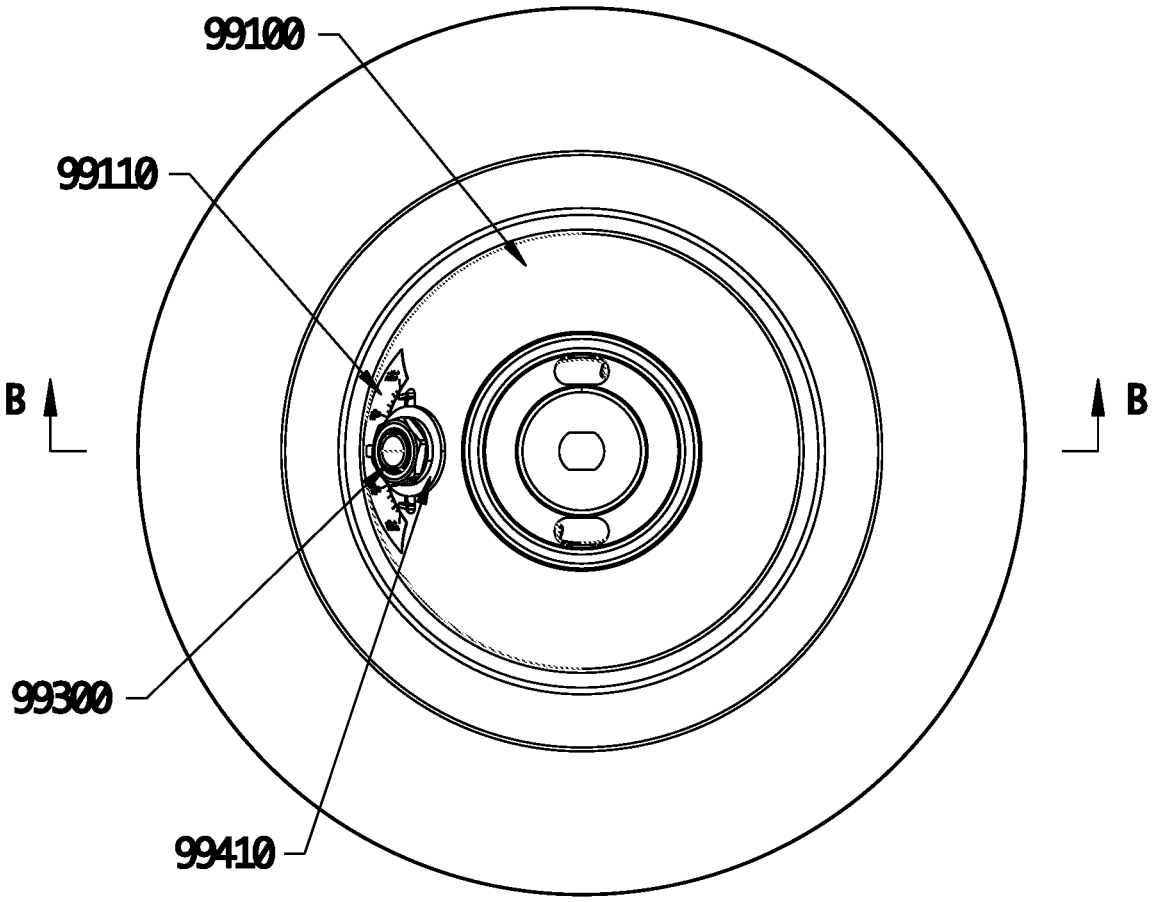
FIG. 14 illustrates a top view of the example in FIG. 12.

FIG. 14 illustrates a top view of the example in FIG. 12.

Figure 15:
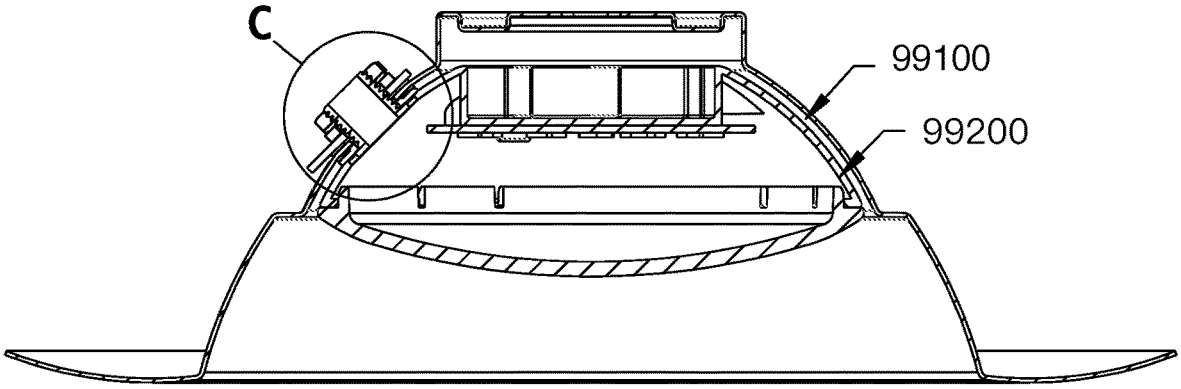
FIG. 15 illustrates a side view of the example in FIG. 12.

FIG. 15 illustrates a side view of the example in FIG. 12. The dome housing 99100 has a heat dissipation housing 99200.

Figure 16:
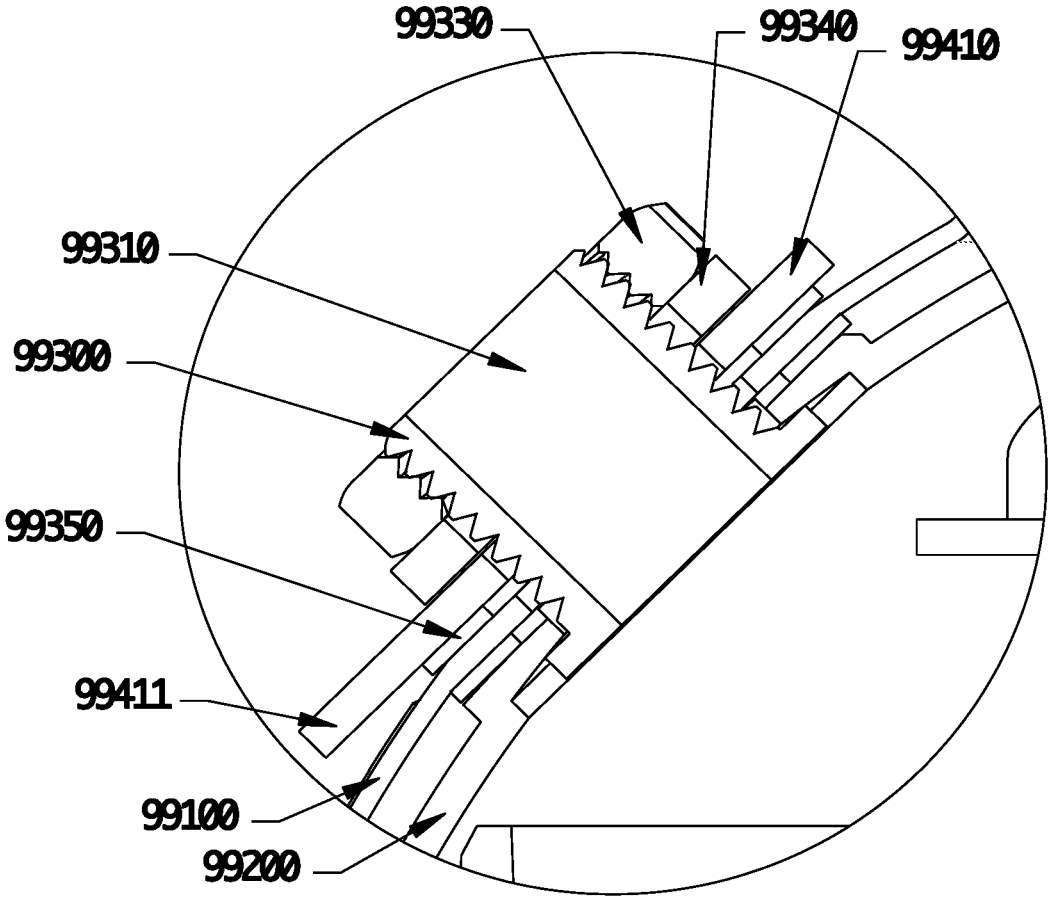
FIG. 16 illustrates a zoom-up view of the example in FIG. 12.

FIG. 16 illustrates a zoom-up view of the example in FIG. 12. FIG. 12 illustrates a screw 9330, a wave shape pad 99340, a stop pad 99410, a wiring hole 99310, a rotation lever 99300, a pad 99350, and a positioning block 99411.

Figure 17:
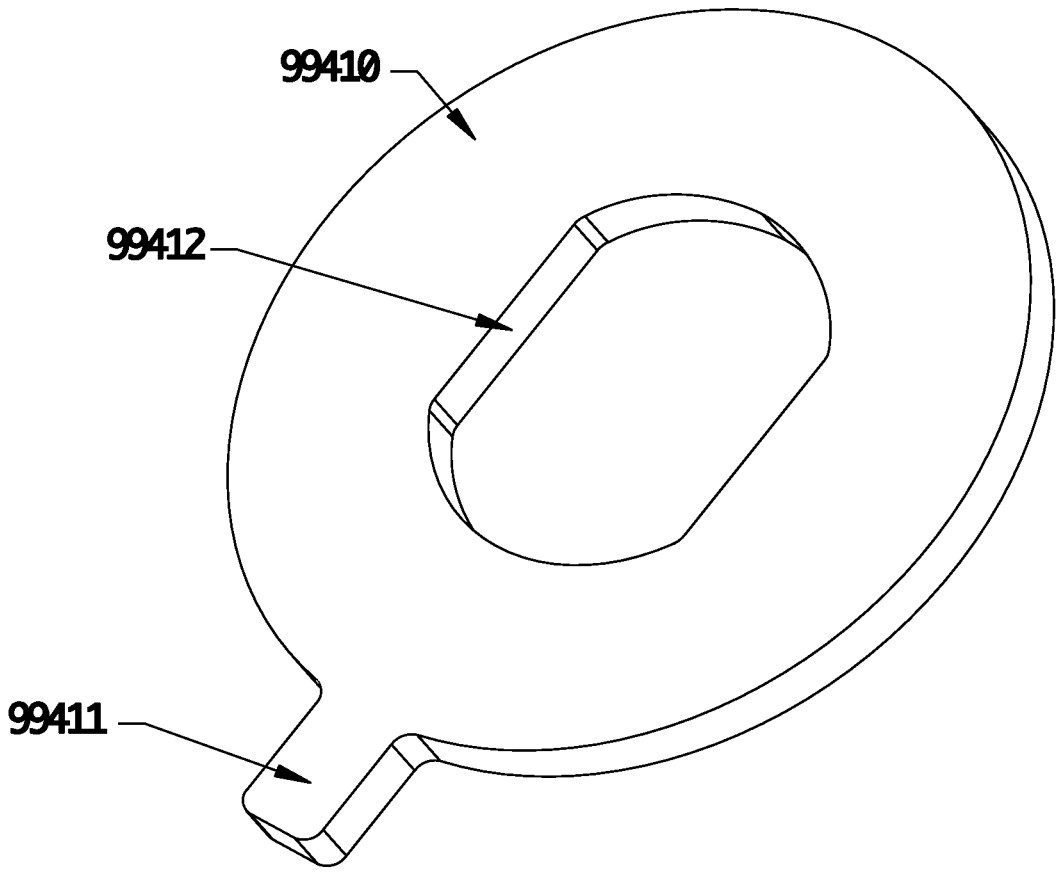
FIG. 17 illustrates a first limiting unit example.

FIG. 17 illustrates a first limiting unit example. The stop pad 99410 has a vertical edge 99412 and a position block 99411.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a housing comprising a rim part and a container part, wherein the container part defines a space, wherein the rim part conceals an installation cavity for installing the lighting apparatus;

a first rotation part;

a light body comprising a light source, wherein the light body is attached to the container part with the first rotation part, wherein the light body is rotatable with respect to the container part along the first rotation part for a first rotation direction, wherein the first rotation part is disposed to the container part with a tilt offset from a top center of the container part;

a second rotation part; and a rotation bracket with a fixing bracket and a central part, wherein the housing is attached to the top center of the central part with the second rotation part for the housing to be rotatable with respect to the rotation bracket for a second rotation direction.

2. The lighting apparatus of claim 1, wherein the first rotation direction is along a first axis and the second rotation direction is along a second axis, wherein the first axis and the second axis has a tilt angle.

3. The lighting apparatus of claim 2, wherein the tilt angle is between 10 degrees to 45 degrees.

4. The lighting apparatus of claim 2, wherein the container part of the housing has a bowl shape.

5. The lighting apparatus of claim 4, wherein the first rotation part has a first limiting unit for limiting a first maximum rotation angle of the first rotation direction.

6. The lighting apparatus of claim 5, wherein the second rotation part has a second limiting unit for limiting a second maximum rotation angle of the second rotation direction.

7. The lighting apparatus of claim 1, further comprising a driver box attached to the central part of the rotation bracket, wherein the driver box and the housing are placed on opposite sides of the central part.

8. The lighting apparatus of claim 7, wherein a driver circuit in the driver box is electrically connected to the light source in the light body via a first conductive path of the second rotation part, a second conductive path of the container part and a third conductive path of the first rotation part.

9. The lighting apparatus of claim 1, wherein the central part is an elongated bar with a central hole for the second rotation part to rotate within the central hole.

10. The lighting apparatus of claim 9, wherein the fixing bracket has two fixing units disposed on two opposite sides of the elongated bar.

11. The lighting apparatus of claim 9, wherein the elongated bar has two sliding tracks for moving the two fixing units to adjust a spanning diameter between the two fixing units to fit in different sizes of the installation cavity.

12. The lighting apparatus of claim 1, wherein the light source comprises a LED module, wherein the light body comprises an optical module for changing a light path of a light of the light source.

13. The lighting apparatus of claim 12, wherein the optical module comprises a reflective cup for guiding the light to a light opening of the light body.

14. The lighting apparatus of claim 13, wherein an inner side of the housing has a reflective layer for reflecting the light of the light source.

15. The lighting apparatus of claim 1, wherein the light body has a handle for a user to hold to rotate the light body along the first rotation part.

16. The lighting apparatus of claim 15, wherein the user holds the handle to rotate the housing along the second rotation part.

17. The lighting apparatus of claim 16, wherein the handle has a switch for changing a light parameter of the light source.

18. The lighting apparatus of claim 17, wherein the switch has a rotation switch part for setting a maximum light intensity of the light source.

19. The lighting apparatus of claim 18, wherein the switch further has a mode switch for adjusting a color temperature of a mixed light output of the light source.

20. The lighting apparatus of claim 1, wherein the first rotation part has a first wiring hole, wherein the second rotation part has a second wiring hole, wherein the first wiring hole and the second wiring hole are used for passing a metal wire for electrically connecting a driver circuit to the light source.

* * * * *